US006546731B2

(12) United States Patent
Alkabie et al.

(10) Patent No.: US 6,546,731 B2
(45) Date of Patent: Apr. 15, 2003

(54) COMBUSTION CHAMBER FOR A GAS TURBINE ENGINE

(75) Inventors: Hisham Salman Alkabie, Sudbrooke (GB); Robin Thomas David McMillan, Bardney (GB)

(73) Assignee: ABB Alstom Power UK Ltd., Lincoln (GB)

( * ) Notice: Subject to any disclaimer, the term of this patent is extended or adjusted under 35 U.S.C. 154(b) by 8 days.

(21) Appl. No.: 09/726,194

(22) Filed: Nov. 29, 2000

(65) Prior Publication Data

US 2001/0004835 A1 Jun. 28, 2001

(30) Foreign Application Priority Data

Dec. 1, 1999 (GB) ..... 9928242

(51) Int. Cl.[7] ..... F23R 3/06
(52) U.S. Cl. ..... 60/754; 60/756; 60/757
(58) Field of Search ..... 60/752, 754, 755, 60/756, 757, 265; 165/914

(56) References Cited

U.S. PATENT DOCUMENTS 4,118,146 A 10/1978 Dierberger
4,168,348 A 9/1979 Bhangu et al.
4,292,376 A 9/1981 Hustler
4,315,406 A 2/1982 Bhangu et al.
4,422,300 A 12/1983 Dierberger et al.
4,695,247 A 9/1987 Enzaki et al.
4,776,172 A 10/1988 Havercroft
5,216,886 A * 6/1993 Ewing ..... 60/754
5,435,139 A 7/1995 Pidcock et al.
5,758,504 A * 6/1998 Abreu et al. ..... 60/754
5,782,294 A 7/1998 Froemming et al.

FOREIGN PATENT DOCUMENTS

GB 2 176 274 A 12/1986

* cited by examiner

*Primary Examiner*—Ted Kim
(74) *Attorney, Agent, or Firm*—Kirschstein, et al.

(57) ABSTRACT

In a twin wall combustion chamber for a gas turbine engine, the outer wall has impingement holes so that compressed air surrounding the chamber can pass through the holes to impinge on the inner wall, and the inner wall has effusion holes whereby air can effuse into the combustion chamber. The number of effusion holes is greater than the number of impingement holes, the effusion-holes preferably being arranged in groups of seven, comprising six holes equi-spaced around a central seventh hole, each group having an impingement hole in a fixed positional relationship to the central hole, preferably downstream of it.

17 Claims, 3 Drawing Sheets

COMBUSTION CHAMBER FOR A GAS TURBINE ENGINE

FIELD OF THE INVENTION

This invention relates to gas turbine engines, and in particular to cooling of combustion chamber walls in such engines.

BACKGROUND TO THE INVENTION

The combustion chambers in gas turbine engines are subject to very high temperatures in use and, as efforts are made to increase engine efficiency, higher operating temperatures become desirable. However, the ability of the combustion chamber walls to withstand higher temperatures becomes a limiting factor in engine development. New wall materials to withstand higher temperatures are constantly being developed, but there is usually some cost or functional penalty involved. As metal alloys become more exotic, they tend to be more expensive, both in the materials required and in the complexity of manufacture. Ceramic materials, on the other hand, while being able to withstand high temperatures, tend to exhibit low mechanical strength.

An alternative approach to the development of new materials is to improve the systems for cooling the walls in use. In one air cooling system, the combustion chamber is formed with twin walls spaced apart from each other by a small distance. Compressed air from the engine compressor surrounds the combustion chambers within the engine casing, and holes formed in the outer wall of the twin walls of the chamber allow air to impinge on the inner wall, creating a first cooling effect. Such holes are normally referred to as impingement holes. The air in the space between the walls is then admitted to the combustion chamber through a series of smaller holes, normally referred to as effusion holes, through the inner wall which are arranged to aid laminar flow of the cooling air in a film over the inner surface of the inner wall, cooling it and providing a protective layer from the combustion gases in the chamber. Examples of such cooling arrangements are disclosed in United Kingdom Patent No. A-2173891 and United Kingdom Patent No. A-2176274. This type of arrangement can have a significant effect in extending the operating life of a combustion chamber.

It has now been found that by adopting a particular arrangement of effusion holes and associated impingement holes, the cooling effect can be enhanced.

SUMMARY OF THE INVENTION

According to the invention, there is provided a combustion chamber for a gas turbine engine, the combustion chamber having:

upstream and downstream ends relative to the direction of combustion gas flow therethrough, an inner wall, an outer wall spaced apart from the inner wall thereby to define a cavity between the walls, the outer wall having a plurality of impingement cooling holes therethrough, whereby, during operation of the engine, compressed air surrounding the chamber can pass through the impingement holes to impinge on the inner wall, the inner wall having a plurality of effusion holes therethrough, whereby air can effuse from the cavity between the inner and outer walls into the combustion chamber, there being a greater number of effusion holes than impingement holes, wherein the effusion holes are arranged in groups, each group comprising a plurality of effusion holes substantially equally spaced apart from each other around a central effusion hole, each group of effusion holes having an impingement hole located in the outer wall such that air passing through the impingement hole impinges on the inner wall at a predetermined position relative to the central effusion hole within a boundary defined by the group of diffusion holes.

Preferably, the effusion holes are arranged in groups of seven, comprising six effusion holes substantially equally spaced around a central seventh effusion hole. The predetermined position of the impingement hole relative to the central effusion hole is preferably such that air passing through the impingement hole impinges on the inner wall closer to the central effusion hole than to the other effusion holes and is in alignment with the central effusion hole along the direction of combustion gas flow in the chamber. Hence, each impingement hole may be located upstream or downstream of the central effusion hole in the group, but is more preferably arranged downstream of the central effusion hole such that the centerline of the impingement hole is spaced from the centerline of the central effusion hole by a distance at least equal to the diameter of the impingement hole.

The groups are suitably arranged in rows extending circumferentially of the chamber. For convenience in manufacturing and to ensure uniform airflows, each group may be spaced from the next in the row by a distance substantially equal to the spacing between adjacent holes in a group and the groups in any one row may be displaced circumferentially from those in the or each adjacent row by a distance substantially equal to half the distance between the central holes in adjacent groups in a row. Furthermore, the longitudinal spacing between the rows may be such that the distance between two adjacent effusion holes which belong to different groups in adjacent rows is the same as the distance between two adjacent holes in the same group of effusion holes.

In a preferred embodiment, additional effusion holes are provided centrally of each set of six holes defined between two adjacent groups in one row and the displaced adjacent group in the next row.

The relative sizes and numbers of the impingement holes and the effusion holes are preferably such that, during operation of the engine, the pressure differential across the outer wall is at least twice the pressure differential across the inner wall; for example, approximately 70% of the total pressure drop across the outer and inner walls may occur across the outer wall and the remainder across the inner wall.

It has been found that the combustion chamber wall temperature during operation of the engine is significantly lower using the arrangement of the invention than is achieved with known cooling arrangements. Benefits are gained from the enhanced film cooling not only in the combustion chamber can, but also into the transition duct which leads from the can into the turbine inlet. The enhanced cooling extends the life of the combustion chamber can and its transition duct, especially when combustion temperatures are increased to improve combustion efficiency.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE ILLUSTRATED EMBODIMENTS

Figure 1:
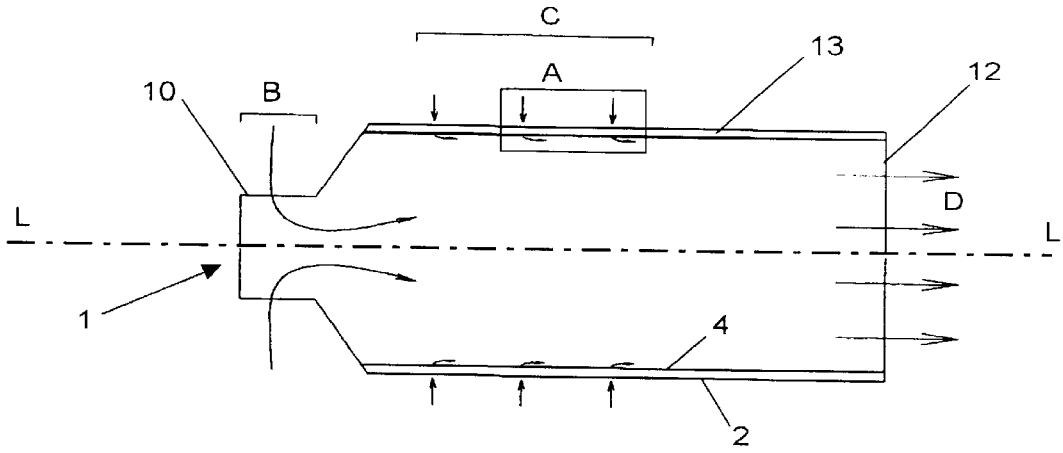
FIG. 1 is a diagrammatic sectional view of a combustion chamber.
Figure 2:
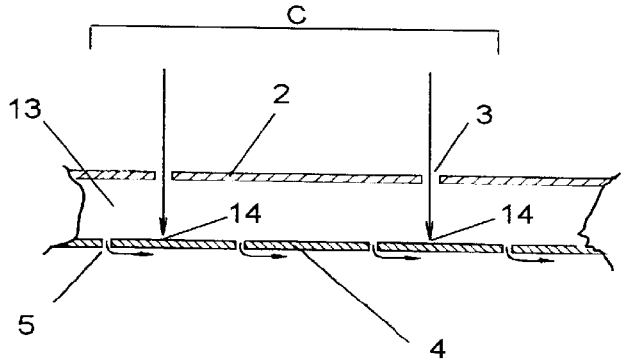
FIG. 2 is an enlarged partial view of the wall of the combustion chamber within box A in FIG. 1.

Referring first to FIG. 1, the combustion chamber can 1 has a conventional inlet or upstream end 10 for fuel and combustion air, and a discharge or downstream end 12, the flow of the combustion air and combustion gases through the chamber being indicated by arrows B and D respectively. Downstream of the inlet end 10 the can is generally cylindrical about its longitudinal axis L-L and has twin walls 2, 4 spaced apart by a small distance in conventional manner to provide a cooling air space cavity 13 between them: The structure of the twin walls may be seen more clearly from FIG. 2, with the outer wall 2 being provided with impingement holes 3 therethrough, while the inner wall 4 has effusion holes 5 therethrough. Although the impingement holes are shown in FIG. 2 as being normal to the longitudinal axis L-L of the can, they may advantageously be angled towards the downstream direction, say at an angle of 30° to the axis L-L, to assist the creation of a boundary layer laminar flow or cooling film over the inner surface of the inner wall 4. The effusion holes are conveniently formed by laser drilling. It will be seen that the impingement holes are arranged such that during operation of the engine, compressed air C from the space within the engine casing surrounding the combustion chamber 1 flows into the cavity 13 between the walls 2 and 4 and impinges directly on the hot inner wall 4 at a position offset from the positions of the effusion holes 5 so that an initial cooling effect on inner wall 4 is achieved by the impingement.

Figure 3:
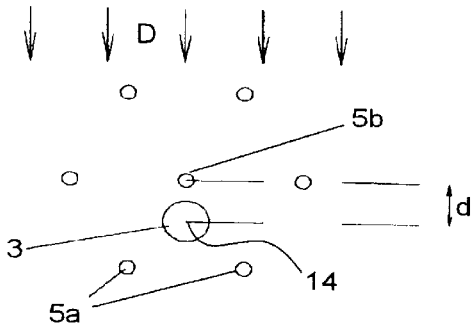
FIG. 3 is an enlarged plan diagram showing the arrangement of cooling holes in a single group of such holes.

As more clearly illustrated in FIG. 3, the effusion holes 5 are arranged in polygonal groups, each group comprising a number of effusion holes 5*a* substantially equally spaced apart from each other around a central effusion hole 5*b*. Each group of effusion holes is associated with a respective impingement hole 3 which is located in the outer wall 2 such that air passing through the impingement hole impinges on the inner wall 4 at a predetermined position 14 relative to the central effusion hole. This center of impingement 14 is within the polygonal boundary defined by the diffusion holes 5*a*.

In the preferred embodiment of the invention, air passing through the impingement holes 3 impinges on the inner wall 4 closer to the central effusion hole 5*b* than to the other effusion holes 5*a*, the center of impingement 14 being in alignment with the central effusion hole 5*b* along the direction D of combustion gas flow in the chamber, and preferably downstream of hole 5*b*.

We have found that the best results are obtained if the effusion holes 5 are arranged in the inner wall 4 in groups of seven as shown, with each of six holes 5*a* defining with the next adjacent hole an equal side of a hexagon, the seventh effusion hole 5*b* being at the center of the hexagon. In this best mode of working the invention, the impingement hole 3 in the outer wall 2 associated with the group is positioned downstream of the central effusion hole 5*b* such that the horizontal distance *d* between the centerline of the central hole 5*b* and the centerline of the impingement hole 3 is at least equal to the diameter of the impingement hole. It will be seen that the impingement holes 3 have a significantly greater diameter than the effusion holes, although the number of effusion holes is substantially greater than the number of impingement holes. The relative sizes and numbers of the two types of hole are designed to ensure that the pressure differential across the outer wall 2 is at least twice the pressure differential across the inner wall 4. Preferably, approximately 70% of the pressure drop across the two walls occurs across the outer wall and the remainder across the inner wall.

Figure 4:
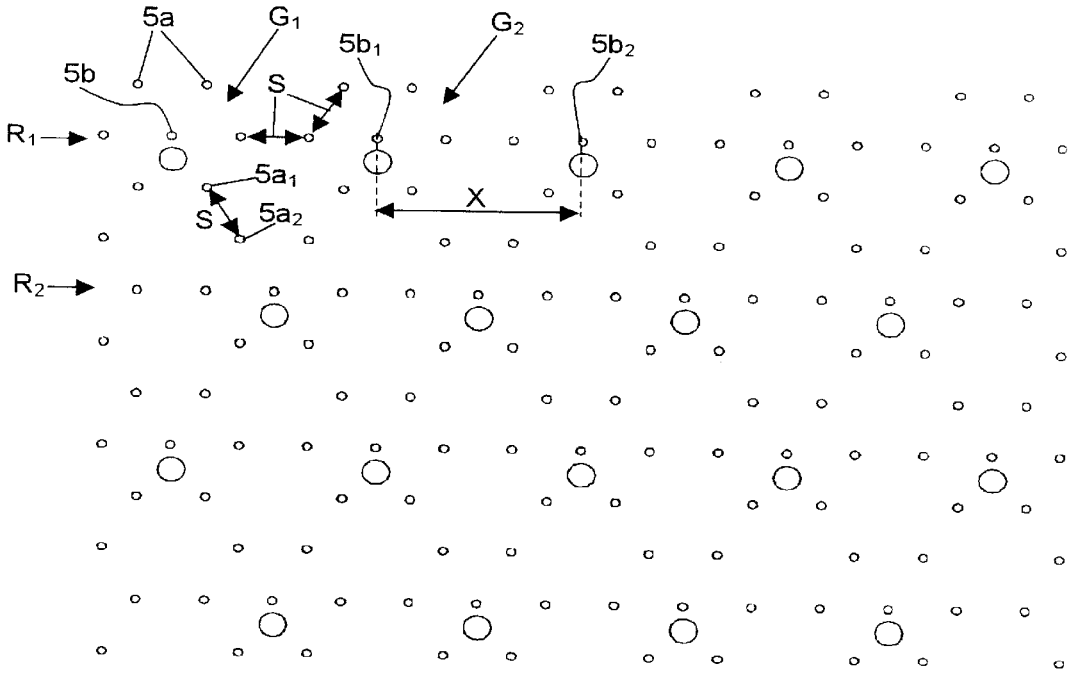
FIG. 4 is a view similar to FIG. 3 but on a reduced scale and showing the relationship between adjacent groups of cooling holes in accordance with one embodiment of the invention.

One exemplary arrangement of the groups of effusion holes is shown in FIG. 4.

The groups $G_1$, $G_2$, etc., each consisting of seven effusion holes 5*a* and 5*b* and the associated impingement hole 3, are arranged in parallel rows $R_1$, $R_2$, etc., extending circumferentially around the can. Regarding layout of the groups within each row, each group $G_1$ is spaced from the next group $G_2$ in the row by a distance S, which as shown is also the spacing between adjacent holes in a group along each side of the hexagon in which they are arranged. Regarding the relationship of the rows to each other, the groups in one row $R_1$ are offset circumferentially from those in the next adjacent row $R_2$ by half the distance X between the adjacent central holes $5b_1$, $5b_2$. Furthermore, the longitudinal spacing between the rows is such that the distance between two adjacent effusion holes which belong to different groups in adjacent rows is the same as the distance between two adjacent holes in the same group. Hence, considering effusion hole $5a_1$ in group $G_1$ of row $R_1$ and an adjacent effusion hole $5a_2$ of another group in the adjacent row $R_2$ the distance between them is S.

Figure 5:
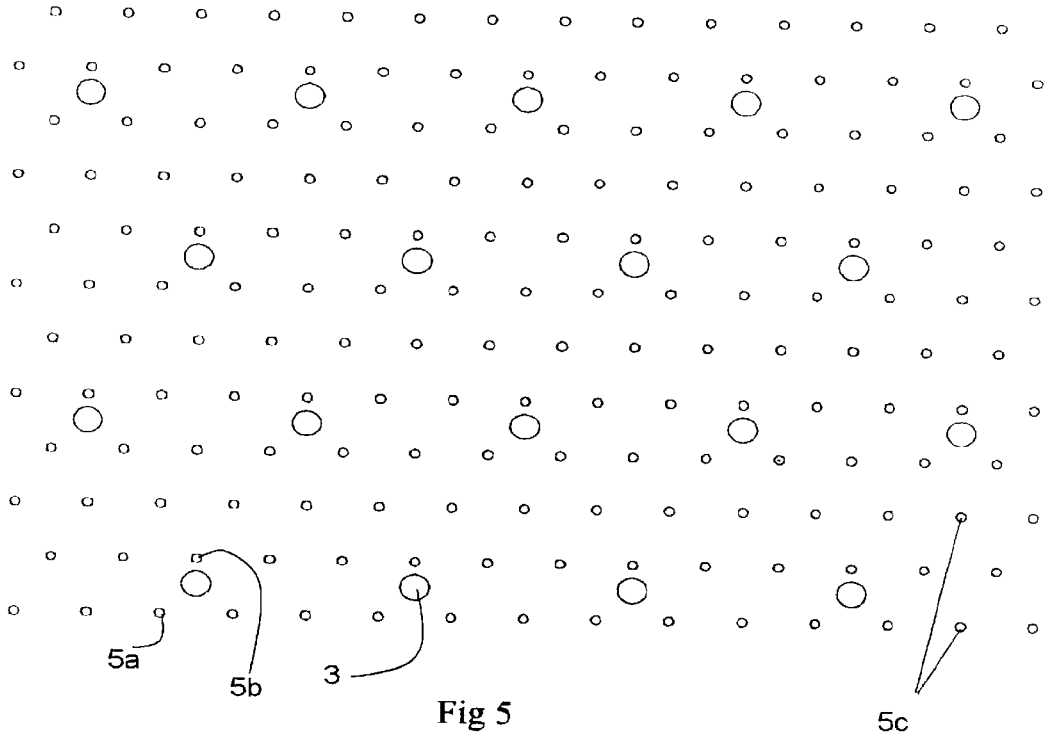
FIG. 5 is a corresponding view to that of FIG. 4, but showing an alternative embodiment of the invention.

In an alternative arrangement of groups shown in FIG. 5, additional effusion holes 5*c* have been added to fill the spaces between the groups in the arrangement shown in FIG. 4. This arrangement increases further the uniformity of coolant gas distribution through the inner wall, further enhancing the cooling film over the inner surface of the inner wall 4.

While we have found groups of seven effusion holes to be optimum, as shown in FIGS. 3 to 5, we do not exclude the possibility that in some circumstances, it may be desirable to have a higher or lower number of effusion holes in each group. The exact number would be established by reference to model tests (virtual or hardware) to take account of differing standards of combustor and differing combustion conditions. Furthermore, although reference has been made to the holes 5*a* being equally spaced around central hole 5*b*, it would of course be possible to vary the exact spacing and positioning of the holes slightly without departing from the proper scope of the invention.

It will be understood that each of the elements described above, or two or more together, also may find a useful application in other types of constructions differing from the types described above.

While the invention has been illustrated and described as embodied in a combustion chamber for a gas turbine engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A combustion chamber for a gas turbine engine, the combustion chamber comprising:

a) upstream and downstream ends relative to a direction of combustion gas flow therethrough, b) an inner wall, c) an outer wall spaced apart from the inner wall such that confronting surfaces of the outer and inner walls do not abut each other, thereby to define a cavity between the walls, d) the outer wall having a plurality of impingement cooling holes therethrough connecting with the cavity, whereby, during operation of the engine, compressed air surrounding the chamber passes through the impingement holes to impinge on the inner wall, e) the inner wall having a plurality of effusion holes therethrough, whereby air effuses from the cavity between the inner and outer walls into the combustion chamber, there being a greater number of effusion holes than impingement holes, and f) the effusion holes being arranged in groups, each group comprising a plurality of the effusion holes substantially equally spaced apart from each other around a central effusion hole, each group of effusion holes having an impingement hole located in the outer wall such that air passing through the impingement hole impinges on the inner wall at a predetermined position offset relative to the central effusion hole within a boundary defined by the group of effusion holes, said impingement within the boundary being a first contact of the air with the inner wall after the air has passed through the impingement hole.

2. The combustion chamber according to claim 1, wherein the effusion holes are arranged in groups of seven, comprising six effusion holes substantially equally spaced around a central seventh effusion hole.

3. The combustion chamber according to claim 1, wherein the predetermined position of the impingement hole relative to the central effusion hole is such that air passing through the impingement hole impinges on the inner wall closer to the central effusion hole than to the other effusion holes.

4. The combustion chamber according to claim 1, wherein the predetermined position of the impingement hole relative to the central effusion hole is such that air passing through the impingement hole impinges on the inner wall in alignment with the central effusion hole along the direction of combustion gas flow in the chamber.

5. The combustion chamber according to claim 4, wherein the predetermined position of the impingement hole relative to the central effusion hole is such that air passing through the impingement hole impinges on the inner wall downstream of the central effusion hole.

6. The combustion chamber according to claim 1, wherein respective center lines of the impingement hole and the central effusion hole are spaced apart by a distance at least equal to a diameter of the impingement hole.

7. The combustion chamber according to claim 1, wherein the groups of effusion holes are arranged in rows extending circumferentially of the chamber.

8. The combustion chamber according to claim 7, wherein each group is spaced from an adjacent group in the row by a distance substantially equal to a spacing between adjacent holes in a group.

9. The combustion chamber according to claim 7, wherein each group is spaced from an adjacent group in the row by a distance substantially equal to a spacing between adjacent holes in a group, and each row is spaced from the adjacent rows by a distance substantially equal to the spacing between adjacent holes in a group.

10. The combustion chamber according to claim 7, wherein the groups in any one row are displaced circumferentially from those in an adjacent row by a distance substantially equal to half a separation between the central holes in adjacent groups in a row.

11. The combustion chamber according to claim 10, wherein additional effusion holes are provided centrally of each set of six holes defined between two adjacent groups in one row and the displaced adjacent group in the next row.

12. The combustion chamber according to claim 1, wherein relative sizes and numbers of the impingement holes and the effusion holes are such that, during operation of the engine, a pressure differential across the outer wall is at least twice a pressure differential across the inner wall.

13. The combustion chamber according to claim 12, in which approximately 70% of a total pressure drop across the outer and inner walls occurs across the outer wall, and a remainder of the total pressure drop occurs across the inner wall.

14. The combustion chamber according to claim 1, wherein the groups of effusion holes are polygonal in shape and consist of holes spaced apart from each other around the periphery of a polygon and the central effusion hole located centrally of the polygon.

15. A gas turbine engine containing at least one combustion chamber, the combustion chamber comprising:

a) upstream and downstream ends relative to a direction of combustion gas flow therethrough, b) an inner wall, c) an outer wall spaced apart from the inner wall such that confronting surfaces of the outer and inner walls do not abut each other, thereby to define a cavity between the walls, d) the outer wall having a plurality of impingement cooling holes therethrough connecting with the cavity, whereby, during operation of the engine, compressed air surrounding the chamber passes through the impingement holes to impinge on the inner wall, e) the inner wall having a plurality of effusion holes therethrough, whereby air effuses from the cavity between the inner and outer walls into the combustion chamber, there being a greater number of effusion holes than impingement holes, and f) the effusion holes being arranged in groups, each group comprising a plurality of the effusion holes substantially equally spaced apart from each other around a central effusion hole, each group of effusion holes having an impingement hole located in the outer wall such that air passing through the impingement hole impinges on the inner wall at a predetermined position offset relative to the central effusion hole within a boundary defined by the group of effusion holes, said impingement within the boundary being a first contact of the air with the inner wall after the air has passed through the impingement hole.

16. A combustion chamber for a gas turbine engine, the combustion chamber comprising:

a) upstream and downstream ends relative to a direction of combustion gas flow therethrough, b) an inner wall, c) an outer wall spaced apart from the inner wall thereby to define a cavity between the walls, d) the outer wall having a plurality of impingement cooling holes therethrough, whereby, during operation of the engine, compressed air surrounding the chamber passes through the impingement holes to impinge on the inner wall, e) the inner wall having a plurality of effusion holes therethrough, whereby air effuses from the cavity between the inner and outer walls into the combustion chamber, there being a greater number of effusion holes than impingement holes, and f) the effusion holes being arranged in groups of seven, each group comprising six effusion holes substantially equally spaced apart from each other around a central seventh effusion hole, each group of effusion holes having an impingement hole located in the outer wall such that air passing through the impingement hole impinges on the inner wall at a predetermined position relative to the central effusion hole within a boundary defined by the group of effusion holes.

17. A combustion chamber for a gas turbine engine, the combustion chamber comprising:

a) upstream and downstream ends relative to a direction of combustion gas flow therethrough, b) an inner wall, c) an outer wall spaced apart from the inner wall thereby to define a cavity between the walls, d) the outer wall having a plurality of impingement cooling holes therethrough, whereby during operation of the engine, compressed air surrounding the chamber passes through the impingement holes to impinge on the inner wall, e) the inner wall having a plurality of effusion holes therethrough, whereby air effuses from the cavity between the inner and outer walls into the combustion chamber, there being a greater number of effusion holes than impingement holes, and f) the effusion holes being arranged in groups, each group comprising a plurality of the effusion holes substantially equally spaced apart from each other around a central effusion hole, each group of effusion holes having an impingement hole located in the outer wall such that air passing through the impingement hole impinges on the inner wall at a predetermined position relative to the central effusion hole within a boundary defined by the group of effusion holes, the groups of effusion holes being arranged in rows extending circumferentially of the chamber, the groups in any one row being displaced circumferentially from those in an adjacent row by a distance substantially equal to half a separation between the central holes in adjacent groups in a row, additional effusion holes being provided centrally of each set of six holes defined between two adjacent groups in one row and the displaced adjacent group in the next row.

* * * * *